US005535453A

United States Patent [19]

Howard

[11] Patent Number: 5,535,453

[45] Date of Patent: Jul. 16, 1996

[54] ADJUSTABLE LENGTH GARMENT

[76] Inventor: Michael A. Howard, 64 Park End Pl., East Orange, N.J. 07018-1114

[21] Appl. No.: 525,928

[22] Filed: Sep. 8, 1995

Related U.S. Application Data

[63] Continuation-in-part of Ser. No. 492,843, Jun. 20, 1995.

[51] Int. Cl.[6] ..... A41D 27/10

[52] U.S. Cl. ..... 2/269; 2/227; 24/446

[58] Field of Search ..... 2/269, 227, 912, 2/919; 24/446

[56] References Cited

U.S. PATENT DOCUMENTS

| | | | |
|---|---|---|---|
| 4,149,275 | 4/1979 | Sanchez | 2/269 |
| 4,200,938 | 5/1980 | LeTourneau | 2/269 |
| 4,896,379 | 1/1990 | Kape | 2/269 |
| 4,985,936 | 1/1991 | Jones | 2/269 |
| 5,088,128 | 2/1992 | Kape | 2/269 |

*Primary Examiner*—Amy B. Vanatta
*Assistant Examiner*—Shirra L. Jenkins
*Attorney, Agent, or Firm*—Goldstein & Associates

[57] ABSTRACT

An adjustable length garment, for adjusting the length of a pant leg having an interior surface and a bottom edge, comprising an adjustment mechanism mounted to the interior surface near the bottom edge. The adjustment mechanism comprises an upper adjustment array and a lower adjustment array near the bottom edge. The adjustment mechanism comprises a vertical strip having an inner seam and an outer seam along which the vertical strip is attached to the interior surface. The adjustment mechanism also comprises fingers attached to the vertical strip along the inner seam, the fingers having integral hook and loop fastener material. The vertical strip has integral hook and loop fastener material for mating the upper adjustment array with the lower adjustment array. The fingers can fold along the inner seam to affix to the vertical strip to cover exposed fastener material.

15 Claims, 2 Drawing Sheets

ADJUSTABLE LENGTH GARMENT

This application is a continuation-in-part of application Ser. No. 08/492,843, filed Jun. 20, 1995.

BACKGROUND OF THE INVENTION

The invention relates to an adjustable length garment. More particularly, the invention relates to a pair of pants that allows for quick and easy adjustment of its length without the need to sew or pin the garment.

Children grow rapidly. Thus, parents are constantly confronted with the need to either adjust hemlines or buy new clothes. Adjusting hemlines can be time consuming, and buying new clothes can be costly.

Adjusting a hemline generally involves cutting the current stitches, unfolding the cuff, resetting the cuff to a desired length, and then restitching the hem. Often an unsightly dirt or fade line is present at the bottom of the old cuff. When the hemline is lengthened, this line is visible on the outside of the pants, near the bottom. This line might be acceptable on a child's play clothes, but is probably not acceptable on the child's better clothing or dress clothing. In addition, stitch lines are often also visible from the old hems.

Buying new clothing is often the only option, especially when a hem has been repeatedly let down. However, since children grow so rapidly, this can be an expensive option. This is profoundly true for a parent with several children, each constantly requiring the purchase of new clothing.

U.S. Pat. No. 4,200,938 to LeTourneau discloses an adjustable pant leg system designed for use by formal clothing rental outlets. In LeTourneau, there is no provision for preventing the hook and loop material from clinging onto other clothing or the wearer's skin.

While these units may be suitable for the particular purpose employed, or for general use, they would not be as suitable for the purposes of the present invention as disclosed hereafter.

SUMMARY OF THE INVENTION

It is an object of the invention to produce an adjustable length garment, having an adjustment mechanism which allow the hem to be set to a variety of lengths without the need for sewing or pinning.

It is another object of the invention that the set length may be maintained with the strength and stability of a permanent hem, while still allowing quick and easy adjustment.

It is yet another object of the invention that the set length may be maintained using integral hook and loop fastener material, which contains hook and loop fastener components in a common plane.

It is a further object of the invention that provision is made to protect the user and his clothes from becoming snagged or caught on the hook and loop fastener material.

It is a still further object of the invention to provide and adjustable length garment that is suitable for use with children, who generally require frequent pant hem adjustment.

The invention is an adjustable length garment, for adjusting the length of a pant leg having an interior surface and a bottom edge, comprising an adjustment mechanism mounted to the interior surface near the bottom edge. The adjustment mechanism comprises an upper adjustment array and a lower adjustment array near the bottom edge. The adjustment mechanism comprises a vertical strip having an inner seam and an outer seam along which the vertical strip is attached to the interior surface. The adjustment mechanism also comprises fingers attached to the vertical strip along the inner seam, the fingers having integral hook and loop fastener material. The vertical strip has integral hook and loop fastener material for mating the upper adjustment array with the lower adjustment array. The fingers can fold along the inner seam to affix to the vertical strip to cover exposed fastener material.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
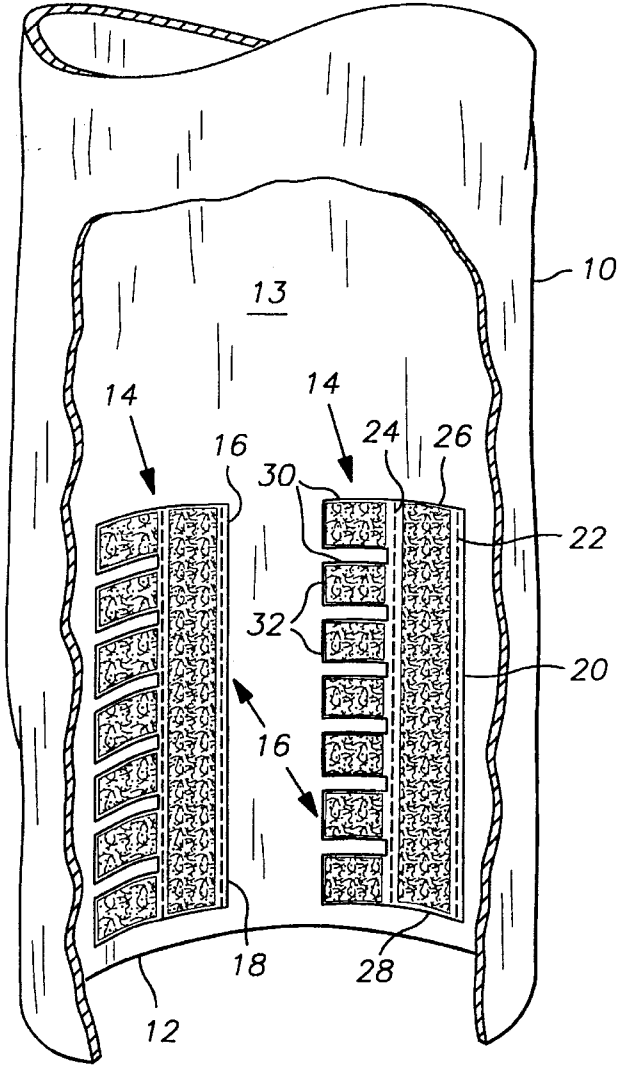
FIG. 1 is a diagrammatic perspective view, with parts broken away, illustrating a pant leg with the instant invention installed.

FIG. 1 illustrates a pant leg 10 having a bottom edge 12, and having an interior surface 13. Adjustment mechanisms 14 are mounted on the interior surface 13 for allowing adjustment of the length of the pant leg 10. The adjustment mechanism 14 comprises an upper adjustment array 16 and a lower adjustment array 18. The lower adjustment array 18 is located near the bottom edge 12 closer to the bottom edge 12 than the upper adjustment array 16.

Figure 4:
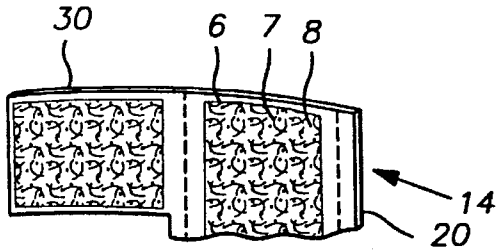
FIG. 4 is an enlarged view, taken in the direction of arrow 4 in FIG. 3, detailing the integral hook and loop fastener material.

The upper adjustment array 16 and lower adjustment array 18 are designed to mate with one another. In order to mate, the upper adjustment array 16 and lower adjustment array 18 can contain hook and loop fastener components. Normally when hook and loop fastener components are used, at certain locations it is imperative for either hook or loop material to be present, since the opposite component would be present at a mating location. However, according to the present invention, integral hook and loop fastener material 6 is used. Referring to FIG. 4, integral hook and loop fastener material 6 contains both hook 7 and loop 8 fastener components in the same plane. Thus, any portion of the plane can be mated with any other portion of that plane. Therefore, any location where hooks or loops would have been used, will now contain the integral hook and loop fastener material.

The adjustment mechanism 14 comprises a vertical strip 20 which extends from the upper adjustment array 16 to the lower adjustment array 18. The vertical strip 20 has an outer seam 22 and an inner seam 24. The adjustment mechanism 14 is stitched to the pant leg along the outer seam and inner seam 24. A vertical strip width is defined as the distance between the outer seam 22 and inner seam 24. The vertical strip also has a vertical strip top 26 and a vertical strip bottom 28. A vertical strip height is defined as the distance between the vertical strip bottom 28 and vertical strip top 26.

A plurality of fingers 30 adjoin the vertical strip 20 along the inner seam 24, each finger above the next along the entire vertical strip height. Each finger 30 has a finger end 32 which is not attached to the pant leg, but is only attached to the vertical strip 20 along the inner seam 32. Thus, each finger 30 is in effect hinged along the inner seam 24. A finger width for each finger 30 is defined as the distance between the inner seam 24 and the finger end 32. Preferably, the finger width is equal to the vertical strip width. Thus, each finger 30 may be folded about the inner seam 24 so that the finger 30 fully overlaps the vertical strip 20, with the finger end 24 coinciding with the outer seam 22.

Figure 2:
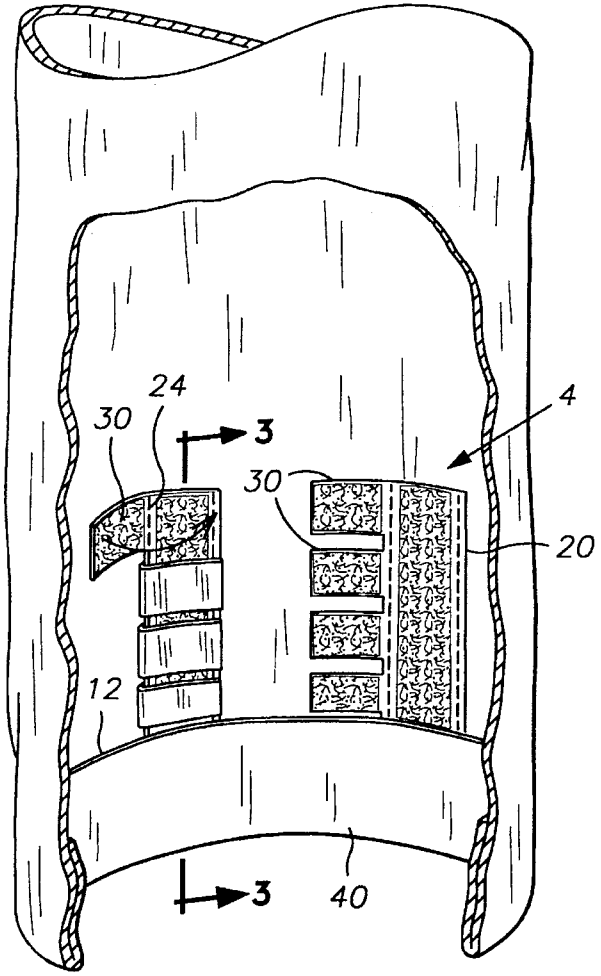
FIG. 2 is a diagrammatic perspective view, with parts broken away, illustrating the invention being used to adjust the length of the pant leg and then hold the adjusted position.

The adjustment mechanism 14 can contain several fingers 30, the purpose of which will become apparent when FIG. 2 is referred to hereinafter. Illustrated in FIG. 1, seven fingers 30 are employed. Also illustrated in FIG. 1, two adjustment mechanisms 14 are shown. However, in reality two more adjustment mechanisms 14 are located opposite the two shown, in the portion of the pant leg 10 that has been removed. An adjustment mechanism 14 should be located opposite each adjustment mechanism 14. Thus, if two are present, they would be located 180 degrees apart around the pant leg 10. In the illustrated embodiment, with four present, they are located approximately 90 degrees apart.

Referring to FIG. 4, the integral hook and loop fastener material 6 is attached on the vertical strip 20 and on the fingers 30. Thus, when the fingers are folded about the inner seam 24, the fingers 30 can adhere to the vertical strip. In addition, any portion of the vertical strip 20 can adhere to any other portion of the vertical strip 20. The use of the integral hook and loop fastener has eliminated the need for a complementary part to mate with the vertical strip 30.

Referring to FIG. 2, the pant leg has been folded under, bringing the bottom edge 12 up inside the pants, thus creating a cuff 40. The lower adjustment array 18 has been inverted 180 degrees, and is thus inside the cuff 40, and now corresponds to the upper adjustment array 16, where it is fastened to maintain the cuff. Next, all fingers 30 above the cuff 40, (i.e. above the bottom edge 12) are folded about the inner seam 24 to mate the integral hook and loop fastener material, so that the fingers 30 adhere to the vertical strip 20. Thus, all exposed hook and loop fastener material is covered and cannot snare other clothing, socks, or the skin of a person wearing the garment.

Figure 3:
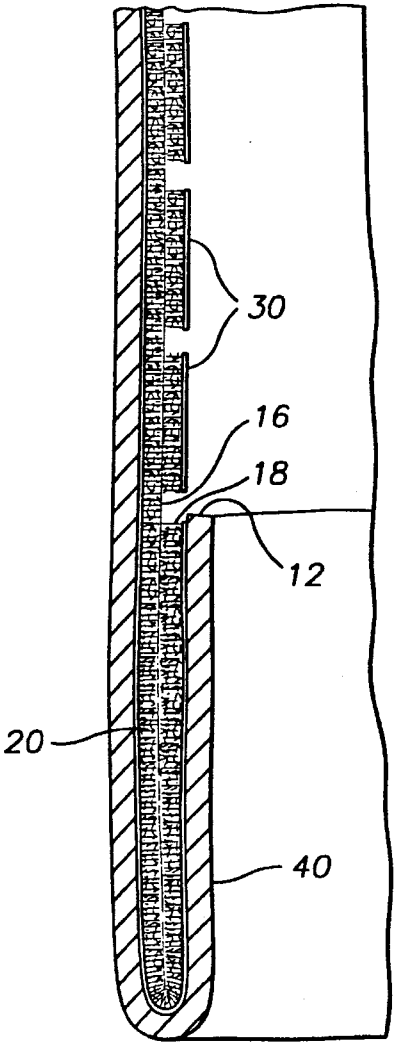
FIG. 3 is an enlarged cross sectional view, taken along line 3—3 in FIG. 2, showing the adjustment mechanism.

Referring to FIG. 3, the cuff 40 has been formed, and is held in place by the vertical strip 20 at the lower adjustment array 18 adhering to the vertical strip 20 at the upper adjustment array 16. The fingers 30 above the bottom edge 12 have been folded, and are also adhering to the vertical strip 20.

When it is necessary to adjust the length of the pant leg 10, the lower adjustment array 18 may be pulled away from the upper adjustment array 16. Then, the fingers 30 are peeled from the vertical strip 20. Next, the bottom edge 12 is folded up into the pant leg 10 to establish a new cuff. The vertical strip 20 on the lower adjustment array 18 is pressed against the vertical strip 20 on the upper adjustment array 16 to hold the cuff. Finally, the fingers 30 above the bottom edge 12 are folded to adhere the fingers 30 to the vertical strip 20.

With frequent adjustments of the hem, it is unlikely that unsightly lines will develop from previous cuffs. However, it is recommended that the user uncuff the pant leg prior to washing the garment, to avoid establishing fade or dirt lines at the bottom of the cuff. It should be noted that this practice would not be possible or practical with a normal sewn hem.

Thus, herein is described a system for adjusting the length of a garment quickly and easily, without the need for sewing or pinning.

What is claimed is:

1. An adjustable length garment system for adjusting the length of a garment having a pant leg, the pant leg having a bottom edge and an interior surface, using integral hook and loop fastener material having hook and loop fastener components in the same plane, comprising:

an adjustment mechanism mounted to the interior surface, comprising:

i) a vertical strip having an inner seam, an outer seam, and having integral hook and loop fastener material, the vertical strip attached to the interior surface along the inner seam and outer seam, the vertical strip attached to the interior surface near the bottom edge, and ii) at least two fingers extending from the inner seam having integral hook and loop fastener material.

2. The adjustable length garment as recited in claim 1, having two adjustment mechanisms mounted to the pant leg interior, each adjustment mechanism having an upper adjustment array and a lower adjustment array, the vertical strip extending from the upper adjustment array to the lower adjustment array, the lower adjustment array attaching to the upper adjustment array by adhering the vertical strip to itself to maintain a cuff on the pant leg.

3. The adjustable length garment as recited in claim 1, wherein the vertical strip has a vertical strip width defined as the distance between the inner seam and outer seam, the fingers each have a finger end, a finger width is defined as the distance between the inner seam and finger end, and the finger width is substantially equal to the vertical strip width, so that each of the fingers may be folded along the inner seam until the finger end coincides with the outer seam and the integral hook and loop fastener material on the vertical strip mates with the integral hook and loop fastener material on the fingers.

4. The adjustable length garment as recited in claim 3, having four or more adjustment mechanisms.

5. The adjustable length garment as recited in claim 4, wherein each adjustment array has six fingers.

6. The adjustable length garment as recited in claim 4, wherein the vertical strip has a vertical strip top and a vertical strip bottom, a vertical strip height is defined as the distance between the vertical strip top and vertical strip bottom, and each of the fingers is located above the next along the vertical strip height.

7. An adjustable length garment method, for adjusting the length of a garment having a pant leg having a bottom edge and an interior surface, using an adjustment mechanism that is attached to the interior surface, the adjustment mechanism having an upper adjustment array and having a lower adjustment array that is located near the bottom edge, the adjustment mechanism having a vertical strip, the vertical strip having integral hook and loop fastener material and having an inner seam and an outer seam that are stitched to the interior surface, fingers are attached to the vertical strip along the inner seam, comprising the steps of:

a) cuffing the pant leg by folding the pant leg under, bringing the bottom edge upward inside the pant leg;

b) setting the cuff by affixing the vertical strip at the lower adjustment array to the vertical strip at the upper adjustment array; and c) covering exposed fastener material by folding the fingers above the bottom edge so that they cover the vertical strip above the bottom edge.

8. The adjustable length garment of claim 7, wherein the fingers contain integral hook and loop fastener material, and the step of folding the fingers above the bottom edge further comprises mating the integral hook and loop fastener material on the fingers with the integral hook and loop fastener material on the vertical strip.

9. The adjustable length garment method of claim 8, wherein the method further comprises the steps of:

d) pulling the vertical strip at the lower adjustment array away from the vertical strip at the upper adjustment array;

e) uncuffing the pant leg;

f) peeling the fingers from the vertical strip; and g) repeating previously recited steps a through c.

10. An adjustable length garment system for adjusting the length of a garment having a pant leg, the pant leg having a bottom edge and an interior surface, using integral hook and loop fastener material having hook and loop fastener components in the same plane, comprising:

an adjustment mechanism mounted to the interior surface having a vertical strip having integral hook and loop fastener material, the vertical strip attached to the interior surface, the vertical strip attached to the interior surface near the bottom edge, the vertical strip capable of adhering to itself.

11. The adjustable length garment as recited in claim 10, having two adjustment mechanisms mounted to the pant leg interior, each adjustment mechanism having an upper adjustment array and a lower adjustment array, the vertical strip extending from the upper adjustment array to the lower adjustment array, the lower adjustment array attaching to the upper adjustment array by adhering the vertical strip to itself to maintain a cuff on the pant leg.

12. The adjustable length garment as recited in claim 10, wherein the vertical strip has an inner seam and an outer seam, the vertical strip has a vertical strip width defined as the distance between the inner seam and outer seam, the fingers each have a finger end, a finger width is defined as the distance between the inner seam and finger end, and the finger width is substantially equal to the vertical strip width, so that each of the fingers may be folded along the inner seam until the finger end coincides with the outer seam and the integral hook and loop fastener material on the vertical strip mates with the integral hook and loop fastener material on the fingers.

13. The adjustable length garment as recited in claim 12, having four or more adjustment mechanisms.

14. The adjustable length garment as recited in claim 13, wherein each adjustment array has six fingers.

15. The adjustable length garment as recited in claim 13, wherein the vertical strip has a vertical strip top and a vertical strip bottom, a vertical strip height is defined as the distance between the vertical strip top and vertical strip bottom, and each of the fingers is located above the next along the vertical strip height.

* * * * *